US005204011A

United States Patent [19]

Nader

[11] Patent Number: 5,204,011

[45] Date of Patent: Apr. 20, 1993

[54] LUBRICANTS CONTAINING ARYL ARENESULFONATES AS LUBRICITY ADDITIVES

[75] Inventor: Bassam S. Nader, Midland, Mich.

[73] Assignee: The Dow Chemical Company, Midland, Mich.

[21] Appl. No.: 894,490

[22] Filed: Jun. 5, 1992

[51] Int. Cl.[5] ..... C10M 135/10; C10M 135/08

[52] U.S. Cl. ..... 252/48.4; 252/48.2

[58] Field of Search ..... 252/48.2, 48.4, 48.6

[56] References Cited

U.S. PATENT DOCUMENTS

| | | | |
|---|---|---|---|
| 2,610,164 | 9/1952 | Gluesenkamp et al. | 260/30.8 |
| 2,819,211 | 1/1958 | Mikeska et al. | 252/42.1 |
| 2,921,965 | 1/1960 | Dazzi | 252/48.4 |
| 2,998,453 | 8/1961 | Nichols | 252/98.2 |
| 2,998,454 | 8/1961 | Nichols | 252/48.2 |
| 3,121,104 | 2/1964 | Burt | 260/456 |
| 3,449,440 | 6/1969 | Anderson | 252/48.2 |
| 3,654,323 | 4/1972 | Clark et al. | 260/400 |
| 4,277,417 | 7/1981 | Varma | 260/456 R |
| 4,569,777 | 2/1986 | Miller et al. | 252/77 |
| 5,066,409 | 11/1991 | Nader | 252/48.2 |
| 5,072,049 | 12/1991 | Stumpp et al. | 568/33 |
| 5,093,155 | 3/1992 | Miyazaki et al. | 427/177 |

FOREIGN PATENT DOCUMENTS

| | | |
|---|---|---|
| 168021 | 1/1954 | Australia . |
| 453717 | 12/1948 | Canada . |
| 1242781 | 6/1967 | Fed. Rep. of Germany . |
| 1064595 | 4/1967 | United Kingdom . |

OTHER PUBLICATIONS

CA 113(12) 99497d.

CA 79 (8) 44184y.

*Primary Examiner*—Ellen McAvoy

[57] ABSTRACT

A lubricating composition which comprises a lubricating fluid and an aryl arenesulfonate in an amount sufficient to increase the lubricity of the lubricating fluid. A process for increasing the lubricity of a lubricating fluid which comprises adding an aryl arenesulfonate to the lubricating fluid in an amount greater than or equal to about 0.5 percent and less than or equal to about 5 percent based on the weight of the lubricating fluid.

40 Claims, No Drawings

LUBRICANTS CONTAINING ARYL ARENESULFONATES AS LUBRICITY ADDITIVES

The U.S. Government has a paid up license in this invention and the right in limited circumstances to require the patent owner to license others on reasonable terms as provided by the terms of contract No. F33615-89-C-2918 awarded by the U.S. Air Force.

BACKGROUND OF THE INVENTION

This invention relates to lubricants containing additives that enhance lubricity.

There are only a few classes of compounds that qualify as high temperature fluids, that is, fluids used at temperatures above 300° C. A well known class of such fluids are the polyaryl ethers such as polyphenyl ether. While these fluids have excellent stability, polyaryl ethers possess poor lubricity behavior. Hence, additives are needed to enhance lubricity of these fluids among other fluids without adversely effecting their stability.

SUMMARY OF THE INVENTION

This invention, in one respect, is a lubricating composition which comprises a lubricating fluid and an aryl arenesulfonate in an amount sufficient to increase the lubricity of the lubricating fluid.

In another respect, this invention is a process for increasing the lubricity of a lubricating fluid which comprises adding an aryl arenesulfonate to the lubricating fluid in an amount greater than or equal to about 0.5 percent and less than or equal to about 5 percent based on the weight of the lubricating fluid.

DETAILED DESCRIPTION OF THE INVENTION

The additives of this invention comprise aryl arenesulfonates. The aryl arenesulfonates contain one, two, or three sulfonate groups (—$SO_3$—) wherein each sulfonate group is attached to two aryl groups. As defined herein, aryl arenesulfonates of this invention are of the formula $ASO_3A$, $ASO_3BSO_3A$, or $(ASO_3)_3B$ wherein A is independently in each occurrence phenyl or substituted phenyl, and wherein B is benzene or two benzene rings connected by a bridging group. Aryl arenedisulfonates can be of the formula $ASO_3Ph(XPh)_ySO_3A$ wherein y is 0 or 1 and wherein X s a divalent bridging group such as $C(CH_3)_2$, O, $OCH_2$, $OCH_2CH_2$, $OCH_2CH_2O$, $C(CF_3)_2$, S, $SO_2$, CO, and 9,9'-fluorene, preferably $C(CH_3)_2$, O, $C(CF_3)_2$, S, $SO_2$, CO, and 9,9'-fluorene. When B is benzene and the aryl arenesulfonate is a disulfonate, the $SO_3A$ groups can be attached in ortho, meta, or para arrangement. When B is two benzene rings connected by a bridging group, each benzene of B can be connected independently in meta or para arrangement. For all of the formulas above, when A is substituted phenyl, the phenyl can be substituted by halo, keto, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloalkylaryloxy. The substituent of the phenyl group can be ortho, meta, or para to the sulfonate group. Preferred alkyl substituents contain up to 8 carbons. More preferred alkyl substituents include methyl, t-butyl, and 1,1,3,3-tetramethylbutyl. A preferred polyhaloalkylaryl substituent is trifluoromethylphenyl. Preferred alkoxy substituents contain up to seven carbon atoms. More preferred alkoxy substituents include methoxy, n-butoxy, n-hexoxy, and n-heptoxy. Preferred aryl substituents include alkylphenyls, tri-t-butylphenyl, and halophenyls. A preferred halophenyl is fluorophenyl. Preferred polyhaloalkoxy substituents include 1,1,3,3,3-pentafluoro-n-propoxy, 1,1,2,3,3,3-hexafluoro-n-propoxy, and trifluoromethoxy. A preferred polyhaloalkyl is polyfluoroalkyl of less than eight carbon atoms, more preferably the polyhaloalkyl substituent is trifluoromethyl. A preferred halo group is fluoro. Preferred aryloxy substituents are phenoxy and halophenoxy, more preferably phenoxy. Preferred keto substituents include methyl keto and phenyl keto.

Examples of the aryl arenesulfonates of this invention are of Formula I:

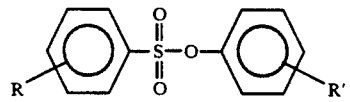

wherein R is hydrogen, 4-methyl, 4-t-butyl, 4-methoxy, 4-n-butoxy, 4-phenoxy, 4-trifluoromethoxy, or 4-(1,1,3,3,3-hexafluoro)-n-propoxy; R' is hydrogen, 4-t-butyl, 3-methoxy, 4-methoxy, 3-n-butoxy, 3-phenoxy, 4-(1,1,3,3-tetra methyl)butyl, 2-t-butyl, 4-n-heptoxy, 4-methyl, 2-t-butyl, 4-n-butoxy, 4-n-hexoxy, 3-methyl, 3-fluoro, 3-trifluoromethyl, 4-methyl keto, or 4-phenyl keto; of Formula II:

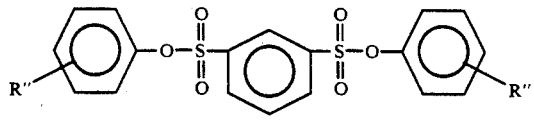

wherein R'' is 3-methoxy, 3-trifluoromethyl, 3-phenoxy, 4-phenoxy, 4-(4-chloro)phenoxy, or 1,1,3,3-tetramethylbutyl; or Formula III:

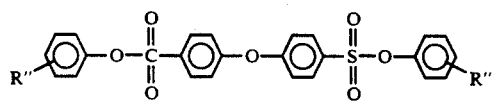

wherein R'' is as defined above; of Formula IV:

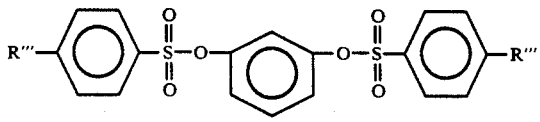

wherein R''' is 1,1-dimethylpropyl, t-butyl, methoxy, n-butoxy, or phenoxy; of Formula V:

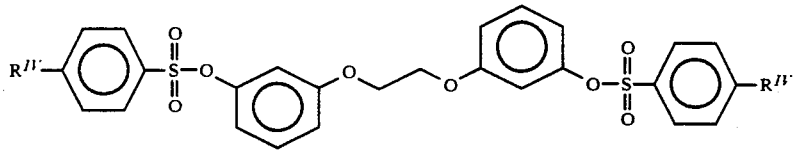

wherein $R^{IV}$ is n-butoxy; of Formula VI:

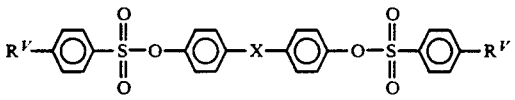

wherein $R^{V}$ is hydrogen, t-butyl, n-butoxy; X is dimethylmethylene, ditrifluoromethylmethylene, oxygen, sulfur, $SO_2$, CO, or 9,9-fluorene; of Formula VII:

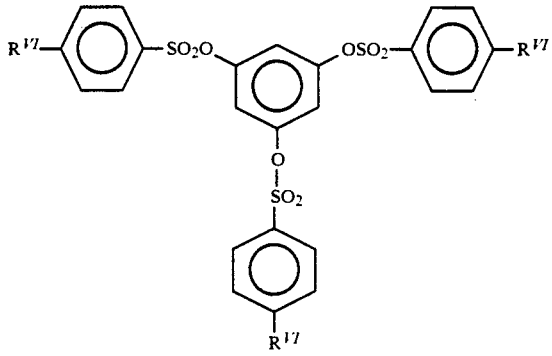

wherein $R^{VI}$ is t-butyl or n-butoxy; or of Formula VIII:

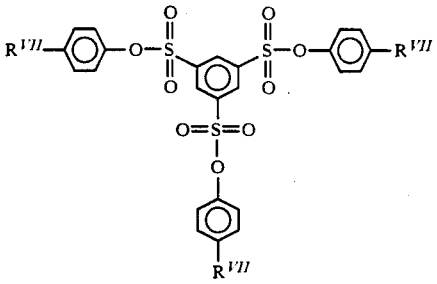

wherein $R^{VIII}$ is 1,1,3,3-tetramethylbutyl.

The most preferred aryl arenesulfonates of this invention possess high oxidation stability. The most preferred aryl arenesulfonates of this invention are aryl arenesulfonates of Formula I wherein R is hydrogen and R' is hydrogen, 4-t-butyl, 3-methoxy, or 3-phenoxy, or wherein R is 4-methyl and R' is hydrogen, 4-(1,1,3,3-tetramethylbutyl), or wherein R is 4-t-butyl and R' is hydrogen, 2-t-butyl, 4-t-butyl, 4-(1,1,3,3-tetramethylbutyl), 3-methoxy, 3-n-butoxy, or wherein R is 4-methoxy and R' is hydrogen, 4-t-butyl, or 3-methoxy, or wherein R is 4-n-butoxy and R' is hydrogen or 3-phenoxy, or wherein R is 4-phenoxy and R' is hydrogen, 3-methyl, 4-t-butyl, 4-(1,1,3,3-tetramethylbutyl), 3-fluoro, 3-trifluormethyl, 3-methoxy, 3-phenoxy, 4-phenyl keto, or wherein R is 1,1,2,3,3,3-hexafluoro-n-propoxy and R' is 4-(1,1,3,3-tetramethylbutyl or of Formula II wherein R'' is 3-methoxy, 3-trifluoromethoxy, 3-phenoxy, 4-phenoxy, 4-(4-chlorophenoxy), or 4-(1,1,3,3-tetramethylbutyl); or of Formula III wherein R''' is 4-(1,1,3,3-tetramethylbutyl) or 3-trifluoromethyl and X is 0: or of the Formula IV wherein R''' is 1,1-dimethylpropyl, t-butyl, methoxy, or phenoxy; or of Formula VI wherein $R^{V}$ and X are as defined above: or of Formula VII wherein $R^{VI}$ is t-butyl: or of Formula VIII wherein $R^{VII}$ is 1,1,3,3-tetramethylbutyl.

The aryl arenesulfonates of this invention are typically prepared by reacting an aryl sulfonyl chloride with phenol or substituted phenol under conditions effective to form the aryl arenesulfonate. This reaction is preferably carried out in the presence of an organic solvent, more preferably an anhydrous organic solvent. Examples of preferred solvents include pyridine, benzene, quinoline, diglyme, triethylamine. dimethyl sulfoxide, dimethyl formamide, n-methyl pyrrolidinone, N,N'-dimethyl acetamide, hexamethylphosphoramide, sulfolane, and toluene. An acid scavenger can also be used such as 4-dimethylaminopyridine. The products of the reaction are generally separated and purified by conventional techniques such as chromatography.

Examples of aryl sulfonyl chlorides suitable as starting materials in the reaction to make aryl arenesulfonates of this invention include benzene sulfonyl chloride and benzene sulfonyl chlorides substituted by halo, keto, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloalkylaryloxy groups. The substituent of the aryl sulfonyl chloride can be in ortho, meta, or para arrangement. When the aryl sulfonyl chloride is substituted by an alkyl group, preferred alkyls contain up to 8 carbons. More preferred alkyls include methyl, t-butyl, and 1,1,3,3 tetramethylbutyl. When the aryl sulfonyl chloride is substituted by an alkoxy group, preferred alkoxy groups contain up to seven carbon atoms. More preferred alkoxy groups include methoxy, n-butoxy, n-hexoxy, and n-heptoxy. Preferred aryl groups of an aryl sulfonyl chloride include alkylphenyls, tri-t-butylphenyl, and halophenyls such as fluorophenyl. Preferred polyhaloalkoxy groups of an aryl sulfonyl chloride include 1,1,3,3,3 pentafluoro-n propoxy, 1,1,2,3,3,3-hexafluoro-n-propoxy, and trifluoromethoxy. A preferred polyhaloalkyl is trifluoromethyl. A preferred halo group is fluoro. A preferred aryloxy group of an aryl sulfonyl chloride is phenoxy. Preferred keto groups include methyl keto and phenyl keto. More preferred aryl sulfonyl chlorides are benzene sulfonyl chlorides substituted by 3-methyl, 4-methyl, 2 t butyl, 4-t butyl, 4-(1,1,3,3-tetramethyl)butyl, 3-trifluoromethyl, 3-methoxy, 4-methoxy, 3n-butoxy, 4-n butoxy, 4-n hexoxy, 4-n-heptoxy, 4-trifluoromethoxy. 4 (1,1,2,3,3,3-hexafluoro)-n-propoxy, 3 phenoxy, 4-phenoxy, 3-fluoro, 4-methyl keto, or 4-phenyl keto groups. If an aryl arenedisulfonate is desired, the disulfonate can be produced by employing either a benzenediol such as 1,4-benzenediol and 1,3-benzenediol or by using as a starting material a benzene disulfonyl chloride such as 1,3-benzene disulfonyl chloride and 1,4-benzene disulfonyl chloride. Similarly, when "B" represents two benzene rings linked by a bridging group, the starting material can be a diol or disulfonyl chloride of "B". Likewise, when an aryl arenetrisulfonate is desired, the trisulfonate can be produced by employing either a benzenetriol, described hereinbelow, or by using as a starting material a trisulfonyl chloride such as 1,3,5-benzene trisulfonyl chloride.

Examples of phenols suitable as starting material in the reaction to make aryl arenesulfonates of this invention include phenol, substituted phenol, 1,4-benzenediol, 1,3-benzenediol, and 1,3,5-benzenetriol. Examples of substituted phenols include phenol substituted by halo, keto, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloalkylaryloxy groups. The substituted phenol can be of ortho, meta, or para arrangement. When the substituted phenol is substituted by an alkyl group, preferred alkyls contain up to 8 carbons. More preferred alkyls include methyl, t-butyl, and 1,1,3,3-tetramethylbutyl. When the substituted phenol is substituted by an alkoxy group, preferred alkoxy groups contain up to seven carbon atoms. More preferred alkoxy groups include methoxy, n-butoxy, n hexoxy, and n-heptoxy. Preferred aryl groups of a substituted phenol include alkylphenyls, tri-t-butylphenyl, and halophenyls such as fluorophenyl. Preferred polyhaloalkoxy groups of a substituted phenol include 1,1,3,3,3-pentafluoro-n-propoxy, 1,1,2,3,3,3-hexafluoro-n-propoxy, and trifluoromethoxy. A preferred polyhaloalkyl is trifluoromethyl. A preferred halo group is fluoro. A preferred aryloxy group of a substituted phenol is phenoxy. Preferred keto groups include methyl keto and phenyl keto. More preferred substituted phenols are phenols substituted by 3-methyl, 4 methyl, 2 t butyl, 4-t butyl, 4-(1,1,3,3 tetra methyl)butyl, 3-trifluoromethyl, 3-methoxy, 4-methoxy, 3-n-butoxy, 4-n-butoxy, 4-n-hexoxy, 4-n-heptoxy, 4-trifluoromethoxy, 4-(1,1,2,3,3,3-hexa-fluoro)-n-propoxy, 3-phenoxy, 4-phenoxy, 3 fluoro, 4-methyl keto, or 4 phenyl keto groups.

The aryl arenesulfonates of this invention are used as lubricity enhancing additives for lubricating fluids in a lubricant composition. As defined herein, lubricating fluids include polyaryl ether fluids, hydrocarbon lubricants such as mineral oil, alpha olefin fluids, silicone fluids and greases, polyalkyl ether fluids, perfluoroalkylpolyether fluids and greases, ester lubricants such as pentaerythritol esters and trimethylol alkane esters, and phosphazene fluids. Most preferably, the lubricating fluid is a polyaryl ether. Examples of polyaryl ethers include para and met forms of bis(phenoxy-phenoxy) benzene (known as "5P4E"), para and meta forms of bis(phenoxyphenyl) ether (known as 4P3E"), and para and meta forms of phenoxy-phenoxy benzene (known as "3P2E").

The aryl arenesulfonates are employed in the lubricant composition in an amount sufficient to increase the lubricity of the lubricating fluid. Preferably, the aryl arenesulfonates are employed in a concentration, based on the weight of the lubricating fluid component, of at least about 0.1 percent, more preferably at least about 0.5 percent, and most preferably at least about 1 percent: and preferably no greater than about 20 percent, more preferably no greater than about 10 percent, and most preferably no greater than about 5 percent. To prepare a solution of the aryl arenesulfonates in the lubricant composition, it is preferable to first dissolve the compound in an organic solvent such as, for example, methylene chloride, and to mix this solution with a solution of the lubricant composition in an organic solvent. The mixture is then preferably filtered to remove solid impurities and any solvents are evaporated from the mixture.

The aryl arenesulfonates of this invention provide a lubricant composition with enhanced lubricity, relative to lubricant or heat-transfer systems which do not contain such compounds. Such compounds are especially useful as additives in high temperature lubricant basestocks which may have the thermal and oxidative stability to withstand high temperature applications, such as in jet aircraft engines, but, which have lubricating properties which are less than desired. An example of such a lubricant basestock is a polyarylether fluid. The lubricity of lubricant compositions may be measured by applying a standard test method as described in ASTM D-2783, "Standard Method for Measurement of Extreme Pressure Properties of Lubricating Fluids (Four ball Method)." In addition, the aryl arenesulfonates of this invention are advantageously thermally and oxidatively stable when used in high temperature applications, and are advantageously soluble when used in such systems.

The aryl arenesulfonates increase lubricity of polyaryl ethers. For example, the lubricity of 5P4E polyphenyl ether fluid is increased greater than 20 percent, preferably greater than 30 percent, when bis[3-phenoxy)phenyl] 1,3-benzenedisulfonate is added at 1 weight percent loading, lubricity being measured by the standard ASTM Four Ball method at 300° C., 15 Kg load, on M50 steel balls, for one hour at 1200 rpm. As used herein, lubricity is measured by this ASTM Four-Ball method.

The following examples are given to illustrate the invention and should not be interpreted as limiting it in any way. Unless stated otherwise, all parts and percentages are given by weight. All reactions requiring anhydrous conditions are performed in oven-dried glassware which was cooled under nitrogen. Thin layer chromatography (TLC) is performed on glass plates precoated with 0.25 mm of silica gel (Analtech, Inc., silica gel GHLF). Flash chromatography is performed on 230–400 mesh silica gel 60. Melting points are determined in open capillary tubes, and are uncorrected.

EXAMPLE 1

Preparation of Bis3-(phenoxy)phenyl1,3-benzenedisulfonate

All apparatus is rigorously dried and flushed with nitrogen before use. The reaction is performed in a 25 ml flask equipped with a magnetic stirring bar and a $CaCl_2$ drying tube. The flask is charged with benzene-1,3-disulfonyl chloride (2.75 grams, 10 mmol), 3-phenoxyphenol (3.72 grams, 20 mmol), and 4-dimethylaminopyridine (60 mg, 0.5 mmol), and anhydrous pyridine (10 ml). The mixture is stirred for 2 hours at ambient temperature. The product is separated by admixing the mixture with water (20 ml) and ethyl ether (30 ml), isolating the organic phase and washing with 25 ml portions of 5 percent HCl (3×), water, 5 percent NaOH, water, and saturated brine, then drying with $MgSO_4$. The organic phase is filtered and is concentrated to leave 3.04 grams of a thick yellow oil. The yellow oil is purified by column chromatography using flash grade silica gel and using 1:1 pentane-$CH_2Cl_2$ initially and then $CH_2Cl_2$ as the eluent. An almost colorless, viscous oil is obtained (2.99 grams, 52 percent yield) of the title compound.

A yield of 84 percent is obtained at 3 times the above scale when the mixture is heated at reflux for 20 hours.

EXAMPLE 2

Preparation of 4-(1,1,3,3-Tetramethylbutyl)phenyl 4-(tert-butyl)benzenesulfonate An oven dried 50 ml 3-necked flask is equipped with a magnetic stirring bar and a $CaCl_2$ drying tube and is charged with 4-tert-butylsulfonyl chloride (7 grams, 30 mmol), 4-(1,1,3,3-tetramethylbutyl)phenol (6.2 grams, 30 mmol , 4-dimethylaminopyridine (0.18 gram, 1.5 mmol), and anhydrous pyridine (20 ml). The mixture is stirred at ambient temperature for 24 hours, then a reflux condenser is attached, and the mixture is heated at reflux for 1 hour. Workup consists of partitioning the mixture between $Et_2O$ and $H_2O$ (75 ml each), and washing the organic phase successively with 50 ml portions of $H_2O$(2×), 5 percent HCl (2×), $H_2O$ (2×), 5 percent NaOH, $H_2O$ (2x), and brine, then drying ($MgSO_4$), filtration and concentration. An amber oil (10.63 grams) is recovered. On standing, a crystalline solid is formed. After recrystallization from hexane, collecting three crops, and a subsequent recrystallization of the combined crops, 5.64 grams (47 percent yield) of the title compound is recovered as white prisms, m.p. 68° C. to 71° C.

EXAMPLE 3

Preparation of Bis[3 trifluoromethyl)phenyl]1,3-benzenedisulfonate

An oven-dried 50 ml 3-necked flask is equipped with a magnetic stirring bar and a $CaCl_2$ drying tube and is charged with benzene-1,3-disulfonyl chloride (6.9 grams, 25 mmol), α,α,α,-trifluoro-m-cresol (6.1 ml, 50 mmol), and 4 dimethylaminopyridine (0.15 gram, 1.25 mmol), and anhydrous pyridine (20 ml) is added. The mixture is stirred at ambient temperature for 24 hours, then a reflux condenser is attached. and the mixture is heated at reflux for 1 hour. Workup consists of partitioning the mixture between $Et_2O$ and $H_2O$ (100 ml each), washing the organic phase successively with 50 ml portions of $H_2O$ (2×), 5 percent HCl (2×), $H_2O$, 5 percent NaOH, $H_2O$ (2×), and brine, then drying ($MgSO_4$), filtration and concentration. A pale yellow oily residue (7.06 grams) is collected. HPLC analysis on a reverse phase column shows the product to contain a small amount of residual α,α, α-trifluoro-m-cresol. The latter is effectively removed by steam distillation on the rotavap to give 6.72 grams (50 percent yield) of the pure title compound as a pale yellow oil.

When this run is repeated on the same scale and under similar conditions, except that the reaction mixture is heated at reflux for 20 hours, the crude oily product obtained after workup crystallized on standing, and is recrystallized from MeOH-$H_2O$ (9:1) to give 10.7 grams (81 percent yield) of white prisms, m.p. 59° C. to 60° C.

EXAMPLE 4

Preparation of Bis[4-(4-chlorophenoxy)phenyl]1.3-Benzenedisulfonate

A 1 liter 3-necked flask is equipped with a mechanical stirrer, a Dean-Stark trap carrying a reflux condenser, and a heating mantle, and is charged with 4-methoxyphenol (35.9 grams, 0.29 mol), 85 percent KOH (19.1 grams, 0.29 mol ,and p-xylene (350 ml). The mixture is heated at reflux for 1 hour, removing the water of reaction azeotropically. Then it is cooled, and 1-chloro-4-iodobenzene (69 grams, 0.29 mol), copper powder (2.9 grams, 46 mmol), and cuprous chloride (2.9 grams, 29 mmol) are added, and the mixture is heated at reflux for 20 hours. Workup consists of diluting the cooled mixture with $Et_2O$ (200 ml), filtration through a medium-fritted funnel, and concentration of the filtrate to leave a deep dark oily residue. This crude material, consisting primarily of 4-(4-chlorophenoxy)anisole, is treated with glacial acetic acid (275 ml) and 48 percent HBr (105 ml), then the mixture is heated at reflux for 24 hours. Workup consists of partitioning the mixture between $H_2O$ (1.2 l) and $CH_2CL_2$ (0.5 l), washing the organic phase with $H_2O$ (0.5 l), and concentration to leave a deep dark oily residue. This residue is taken up in ethanol (0.5 l) and treated with activated carbon (Norit; ca. 50 grams). Filtration through celite, and concentration of the filtrate gave the crude title compound as a thick, red oil. Further purification of the product is achieved by chromatography on a column packed with flash-grade silica gel (6"×2" i.d.), eluting with $CH_2CL_2$, to give after concentration a pinkish solid, which is subsequently recrystallized from hexane-EtOAc to give 31.4 grams (49 percent yield) of pure 4-(4-chlorophenoxy)-phenol as off-white prisms, m.p. 85° C. to 86° C.

EXAMPLE 5

Preparation of 1,3-Bis[4-methoxybenzenesulfonyloxy]benzene

A 25 ml 3-necked flask is equipped with a magnetic stirring bar and a reflux condenser fitted with a $CaCl_2$ drying tube and is charged with resorcinol (2.9 grams, 27 mmol), 4-methoxybenzenesulfonyl chloride (12.1 grams, 58 mmol), pyridine (20 ml), and 4-dimethylaminopyridine (0.2 gram, 1.3 mmol). The stirred mixture is heated at reflux for 10 hours, then is stirred at ambient temperature for 24 hours. Workup consists of partitioning the mixture between $Et_2O$ and $H_2O$ (50ml each , washing the organic phase successively with 50ml portions of $H_2O$, 5 percent HCl (2×), $H_2O$, 5 percent NaOH, $H_2O$, and brine, drying ($MgSO_4$), filtration and concentration. This gives 10.5 grams of an amber oil. A crystalline solid is formed by treating with methanol at ambient temperature. Recrystallization twice from MeOH gives 8.8 grams (73 percent yield) of the title compound as white needles, m.p. 81° C. to 84° C.

EXAMPLE 6

Preparation of 2,2-Bis[4-(benzenesulfonyloxy)phenyl]propane

An oven dried 100 ml 3 -necked flask is equipped with a magnetic stirring bar, a reflux condenser carrying a $CaCl_2$-Drierite drying tube, and a heating mantle, and is charged with 4,4'-isopropylidenediphenol (4.5 grams, 19.7 mmol), 4-dimethylaminopyridine (0.48 gram, 3.93 mmol), and anhydrous $Et_3N$ (40 ml). The solution is stirred and treated slowly with benzenesulfonyl chloride (5.7 mL, 44.7 mmol) via syringe. The resulting mixture is heated at reflux for 9 hours. Workup consists of partitioning the reaction mixture between $CH_2Cl_2$ (100 ml and a mixture of water (150 ml) and concentrated HCl (40 ml), then washing the organic phase successively with 100 ml portions of water, 5 Percent NaOH, water, and saturated brine. Drying ($MgSO_4$), filtration and concentration gives 10.6 grams of a deep dark oily residue. TLC analysis on silica gel shows one major component ($R_f$=0.45: $CH_2Cl_2$), and some minor more polar components. Chromatography on a column packed with flash-grade silica gel (6"×1" i.d.), eluting with $CH_2Cl_2$, gives 9.71 grams of a yellow oil. Crystallization from EtOAc-MeOH-$H_2O$ (20 ml:100 ml: 10 ml), using seed crystals obtained from a microcrystallization on a small sample, affords 8.35 grams (83.5 percent yield) of the title compound as a white crystalline solid, m.p. 92° C. to 93° C.

EXAMPLE 7

Preparation of 2,2-Bis[4-(benzenesulfonyloxy)phenyl]-1,1,1,3,3,3-hexafluoropropane An oven-dried 100 ml 3-necked flask is equipped with a magnetic stirring bar, a reflux condenser carrying a $CaCl_2$-Drierite drying tube, and a heating mantle, and is charged with 4,4'-(hexafluoroisopropylidene)diphenol (Aldrich) (5.45 grams, 16.2 mmol), 4-dimethylaminopyridine (0.4 gram, 3.3 mmol), and anhydrous $Et_3N$ (40 ml). The solution is stirred and treated slowly with benzenesulfonyl chloride (4.7 ml, 36.8 mmol) via syringe. The resulting mixture is heated at reflux for 9 hours. Workup consists of partitioning the reaction mixture between $CH_2Cl_2$ (100 ml) and a mixture of $H_2O$ (150 ml) and concentrated HCl (40 ml), washing the organic phase successively with 100 ml portions of $H_2O$, 5 percent NaOH, $H_2O$, and saturated brine, drying ($MgSO_4$), filtration and concentration. This gives 10.6 grams of a reddish oily residue. TLC analysis on silica gel shows one main component ($R_f$=0.54; $CH_2Cl_2$). Chromatography on a column packed with flash-grade silica gel (3"×1" i.d.), eluting with $CH_2Cl_2$, gives 9.32 grams of a faintly yellowish oil. which solidifies on standing. Recrystallization from EtOAc-MeOH-$H_2O$ (20 ml:100 ml:10 ml)affords 8.91 grams crystalline solid. m.p. 133° C. to 134° C.

EXAMPLE 8

Preparation of 2,2-Bis[4-(4-tert-butylbenzenesulfonyloxy) phenyl]propane

An oven-dried 50 ml 3 necked flask is equipped with a magnetic stirring bar and reflux condenser carrying a $CaCl_2$ drying tube and is charged with 4-tert-butylbenzenesulfonyl chloride 9.3 grams (40 mmol), 4,4'-isopropylidenediphenol (4.11 grams, 18 mmol), 4-dimethylaminopyridine 0.11 gram, 0 9 mmol), and anhydrous pyridine (20 ml), and the mixture is stirred and heated at reflux for 14 hours. Workup consists of partitioning the mixture between $Et_2O$ and $H_2O$ (50 ml each), washing the organic phase successively with 100 ml portions of $H_2O$ (2×), 5 percent HCl (2×), $H_2O$, saturated (2×), $H_2O$ and brine, then drying ($MgSO_4$). filtration and concentration. This gives 10.41 grams of a pale yellow sold. Three consecutive recrystallizations from EtOH-MeOH (2:1) affords 7.87 grams (70 percent yield) of the title compound as white prisms. m.p. 124° C. to 127° C.

EXAMPLE 9

Preparation of 2,2-Bis[4-(4-tert-butylbenzenesulfonyloxy)phenyl]-1,1,1,3,3,3-hexafluoropropane An oven dried 50 ml 3-necked flask is equipped with a magnetic stirring bar and a reflux condenser carrying a $CaCl_2$ drying tube and is charged with 4-tert-butylbenzenesulfonyl chloride 8.14 grams (35 mmol), 4,4'-hexafluoroisopropylidenediphenol (5.37 grams, 16 mmol), 4-dimethylaminopyridine (0.1 grams, 0.8 mmol), and anhydrous pyridine (20 ml), and the mixture is stirred and heated at reflux for 15 hours. Workup consists of partitioning the mixture between $Et_2O$ and $H_2O$ (50 ml each), washing the organic phase successively with 100 ml portions of $H_2O$, 5 percent HCl, $H_2O$, saturated $NaHCO_3$, $H_2O$ and brine, then drying ($MgSO_4$), filtration and concentration. This gives 10.03 grams of a pale yellow oil. Crystallization from EtOH-MeOH (2:1) affords 7.53 grams (64 percent yield) of the title compound as white prisms, m.p. 177° C. to 180° C.

EXAMPLE 10

Preparation of Bis[4-(benzenesulfonyloxy)phenyl] Ether

An oven-dried 100 ml 3-necked flask is equipped with a magnetic stirring bar, a reflux condenser carrying a $CaCl_2$-Drierite drying tube, and a heating mantle, and is charged with 4,4'-oxydiphenol (Pfaltz & Bauer (4.2 grams, 20.8 mmol), 4-dimethylaminopyridine (0.5 gram, 4.1 mmol), and anhydrous $Et_3N$ (40 ml), and the stirred solution is treated slowly with benzenesulfonyl chloride (6 ml, 47 mmol) via syringe. The resulting mixture is heated at reflux for 9 hours. Workup consists of partitioning the reaction mixture between $CH_2Cl_2$ (100 ml) and a mixture of water (150 ml) and concentrated HCl (40 ml), then washing the organic phase successively with 100 ml portions of water, 5 percent NaOH, water, and saturated brine. Drying ($MgSO_4$), filtration and concentration gives a red oily residue. TLC analysis on silica gel shows one major component ($R_f$=0.36; $CH_2Cl_2$), and some minor more polar components. Chromatography on a column packed with flash-grade silica gel (6"×1" i.d.), eluting with $CH_2Cl_2$, gives 7.64 grams of a faintly yellowish oil, which solidifies on standing. Recrystallization from a mixture of EtOAc (20 ml) and water (10 ml) affords 6.23 grams (62 percent yield) of the title compound as a white crystalline solid, m.p. 129° C. to 130° C.

EXAMPLE 11

Preparation of Bis[4-(benzenesulfonyloxy)phenyl] Sulfide

A 100 ml 3-necked oven dried flask is equipped with a magnetic stirring bar and a $CaCl_2$-Drierite drying tube and is charged with 4,4'-thiodiphenol (5.3 grams, 24.3 mmol), benzenesulfonyl chloride (6.5 ml, 50.9 mmol), 4-dimethylaminopyridene (0.59 grams, 4.8 mmol), and anhydrous pyridine (40 ml). The mixture is stirred at ambient temperature for 18 hours, and at reflux for 4 hours, then is poured into ice-cold water (100 ml) with vigorous stirring, and the yellow oil that separates is extracted into $CH_2Cl_2$ (100 ml), and washed with water (100 ml). Drying ($MgSO_4$), filtration and concentration affords a yellow oil. Purification by filtration through a column packed with flash grade silica gel (5"×2" i.d.), eluting with $CH_2Cl_2$(ca. 0.5 l), gives after solvent removal under vacuum 11.8 grams (98 percent yield) of the title compound as a faintly yellowish, thick glass material.

EXAMPLE 12

Preparation of 9,9-Bis[4-(benzenesulfonyloxy)phenyl]fluorene

An oven dried 100 ml 3-necked flask is equipped with a magnetic stirring bar, a reflux condenser carrying a $CaCl_2$-Drierite drying tube, and a heating mantle, and is charged with 9,9-bis(4-hydroxyphenyl)fluorene (3 grams, 16.1 mmol) 4-dimethylaminopyridine (0.4 gram, 3.3 mmol), and anhydrous pyridine 35 ml). The solution is stirred and treated slowly with benzenesulfonyl chloride (4.7 ml, 36.8 mmol) via syringe. The resulting mixture is heated at reflux for 16 hours, then is poured into water (200 ml) with vigorous stirring, resulting in the separation of a gummy white solid. The supernatant aqueous liquid is decanted, and the solid is taken up in $CH_2Cl_2$ (100 ml) and washed successively with 100 ml portions of 5 percent HCl, water and saturated brine, then is dried ($MgSO_4$), filtered and concentrated to leave a white solid. Recrystallization from Hexane-EtOAc affords 7.55 grams (74 percent yield) of the title compound as white fluffy crystals, m.p. 225° C. to 225.5° C.

EXAMPLE 13

Preparation and Evaluation of Mixtures of Polyaryl Ether and Various Disulfonate Additives A formulation of 5P4E polyphenyl ether fluid containing 1 weight percent of the disulfonate of Example 1 is evaluated for lubricity using the ASTM Four-Ball method at 300° C., 15 Kg load, on M50 steel balls, for 1 hour at 1200 rpm. This formulation exhibited reduced wear on the balls as compared with an identical evaluation using 5P4E polyphenyl ether containing no additive. In a control run with no additive, a wear scar diameter (in millimeters) of 2.36 and a coefficient of 0.19 is observed. Wear reduction percentages of the additives is calculated as the percentage decrease in wear scar diameter relative to the control run ([100×(2.36—wear scar diameter when an additive is present)2.36]). When the disulfonate of Example 1 is employed as the additive, a 33 percent wear reduction is observed based on a wear scar diameter of 1.58. When the disulfonate of Example 3 is employed as the additive, a 22 percent wear reduction is observed based on a wear scar diameter of 1.83. When the disulfonate of Example 6 is employed as the additive, a 15 percent wear reduction is observed based on a wear scar diameter of 2.01. When the disulfonate of Example 7 is employed as the additive, a 6 percent wear reduction is observed based on a wear scar diameter of 2.21. When the disulfonate of Example 10 is employed, a 17 percent wear reduction is observed based on a wear scar diameter of 1.97.

What is claimed is:

1. A lubricating composition which comprises a lubricating fluid and an aryl arenesulfonate in an amount sufficient to increase the lubricity of the lubricating fluid, wherein the aryl arenesulfonate is of the formula $ASO_3A$, $ASO_3BSO_3A$, or $(ASO_3)_3B$ wherein A is independently in each occurrence phenyl or substituted phenyl, wherein when A is substituted phenyl the phenyl can be substituted by halo, keto, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloaryloxy, and wherein B is benzene or two benzene rings connected by a divalent bridging group selected from the group consisting of $C(CH_3)_2$, O, $OCH_2$, $OCH_2CH_2$, $OCH_2CH_2O$, $C(CF_3)_2$, S, $SO_2$, CO, and 9,9'-fluorene.

2. The lubricating composition of claim 1 wherein the amount of aryl arenesulfonate is greater than or equal to about 0.1 percent and less than or equal to about 20 percent based on the weight of the lubricating fluid.

3. The lubricating composition of claim 1 wherein the amount of aryl arenesulfonate is greater than or equal to about 0.5 percent and less than or equal to about 10 percent.

4. The lubricating composition of claim 1 wherein the amount of aryl arenesulfonate is greater than or equal to about 1 percent and is less than or equal to about 5 percent.

5. The lubricating composition of claim 2 wherein the lubricating fluid is a polyarylether.

6. The aryl arenesulfonate of claim 1 wherein A is substituted phenyl and the halo substituent is fluoro or chloro.

7. The aryl arenesulfonate of claim 1 wherein the keto substituent is methyl keto or phenyl keto.

8. The aryl arenesulfonate of claim 1 wherein A is substituted phenyl and the alkyl substituent is an alkyl group containing up to eight carbons.

9. The aryl arenesulfonate of claim 8 wherein the alkyl substituent is methyl, t butyl, or 1,1,3,3-tetramethylbutyl.

10. The aryl arenesulfonate of claim 1 wherein the polyhaloalkyl substituent is polyfluoroalkyl wherein the alkyl contains up to eight carbon atoms.

11. The aryl arenesulfonate of claim 1 wherein A is substituted phenyl and the alkoxy substituent is an alkoxy group containing up to seven carbon atoms.

12. The aryl arenesulfonate of claim 11 wherein the alkoxy substituent is methoxy, n-butoxy, n-hexoxy or n-heptoxy.

13. The aryl arenesulfonate of claim 1 wherein A is substituted phenyl and the aryl substituent is alkylphenyl, tri-t-butylphenyl, or halophenyl.

14. The aryl arenesulfonate of claim 13 wherein the halophenyl is fluorophenyl.

15. The aryl arenesulfonate of claim 1 wherein the polyhaloalkoxyaryl substituent is 1,1,3,3,3-pentafluoro-n-propoxy, 1,1,2,3,3,3-pentafluoro-n-propoxy, or trifluoromethoxy.

16. The aryl arenesulfonate of claim 1 wherein the polyhaloalkylaryl substituent is trifluoromethylphenyl.

17. The aryl arenesulfonate of claim 1 wherein the aryloxy group is phenoxy.

18. The aryl arenesulfonate of claim 1 wherein the polyhaloalkoxy group is polyfluoroalkoxy.

19. The aryl arenesulfonate of claim 1 wherein the divalent bridging group is $C(CH_3)_2$, O, $C(CF_3)_2$, S, $SO_2$, CO, or 9,9-fluorene.

20. The lubricating composition of claim 1 wherein the aryl arenesulfonate is of Formula I:

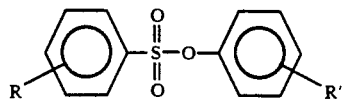

wherein R is hydrogen, 4-methyl, 4-t-butyl, 4-methoxy, 4-n-butoxy, 4-phenoxy, 4-trifluoromethoxy, or 4-(1,1,3,3,3-hexafluoro)-n-propoxy; R' is hydrogen, 4-t-butyl, 3-methoxy, 4-methoxy, 3-n-butoxy, 3-phenoxy, 4-(1,1,3,3-tetra methyl)butyl, 2t-butyl, 4 n-heptoxy, 4-methyl, 2-t-butyl, 4-n-butoxy, 4-n-hexoxy, 3-methyl, 3-fluoro, 3-trifluoromethyl, 4-methyl keto, or 4-phenyl keto; of Formula II:

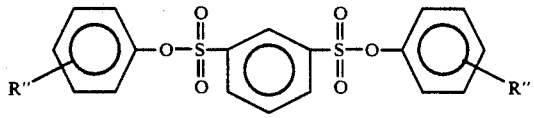

wherein R'' is 3-methoxy, 3-trifluoromethyl, 3-phenoxy, 4-phenoxy, 4-(4-chloro)phenoxy, or (1,1,3,3-tetramethyl)butyl: of Formula III:

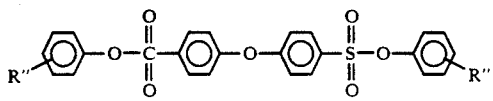

wherein R'' is as defined above; of Formula IV:

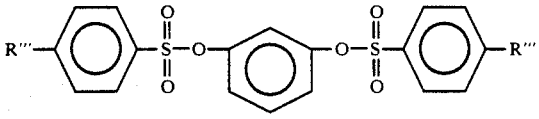

wherein R'''is (1,1-dimethyl) propyl, t-butyl, methoxy, n-butoxy, or phenoxy; of Formula V:

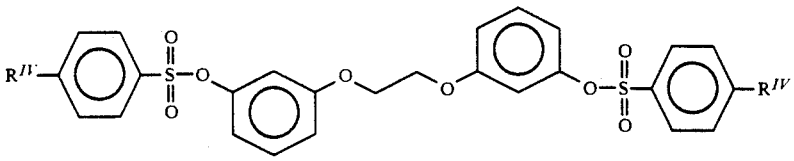

wherein $R^{IV}$ is n-butoxy; of Formula VI:

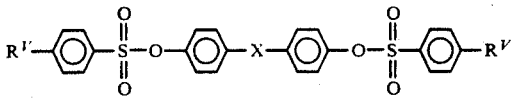

wherein $R^{V}$ is hydrogen, t-butyl, n-butoxy; X is dimethylmethylene, ditrifluoromethylmethylene, oxygen, sulfur, $SO_2$, CO, or 9,9-fluorene; of Formula VII:

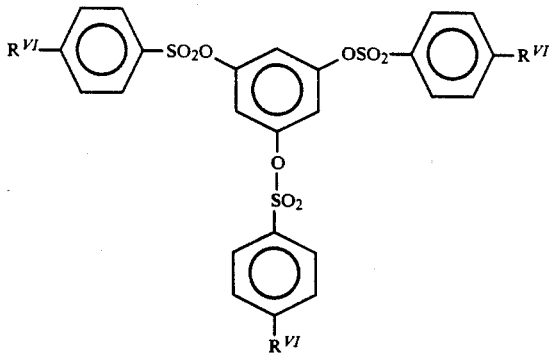

wherein $R^{VI}$ is t-butyl or n-butoxy, or of Formula VIII:

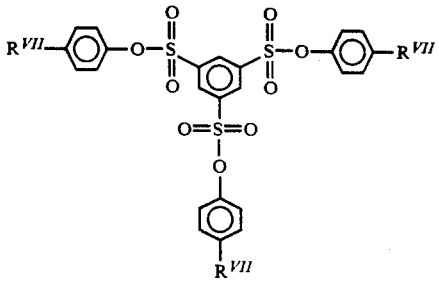

wherein $R^{VII}$ is 1,1,3,3-tetramethylbutyl.

21. The lubricating composition of claim 20 wherein the aryl arenesulfonate is of Formula I wherein R is hydrogen and R' is hydrogen, 4-t-butyl, 3-methoxy, or 3-phenoxy, or wherein R is 4-methyl and R' is hydrogen, 4-(1,1,3,3-tetramethylbutyl), or wherein R is 4-t-butyl and R' is hydrogen, 2-t-butyl, 4-t-butyl, 4-(1,1,3,3-tetramethylbutyl), 3-methoxy, 3-n-butoxy, or wherein R is 4-methoxy and R' is hydrogen, 4-t-butyl, or 3-methoxy, or wherein R is 4-n-butoxy and R' is hydrogen or 3-phenoxy, or wherein R is 4-phenoxy and R' is hydrogen, 3-methyl, 4-t-butyl, 4-(1,1,3,3-tetramethylbutyl), 3-fluoro, 3-trifluormethyl, 3-methoxy, 3phenoxy, 4-phenyl keto, or wherein R is 1,1,2,3,3,3-hexafluoro-n-propoxy and R' is 4-(1,1,3,3-tetramethylbutyl); of Formula II wherein R'' is 3-methoxy, 3-trifluoromethoxy, 3-phenoxy, 4-phenoxy, 4-(4-chlorophenoxy), or 4-(1,1,3,3-tetra-methylbutyl): of Formula III wherein R'' is 4-(1,1,3,3-tetra-methylbutyl) or 3-trifluoromethyl and X is 0; of the Formula IV wherein R''' is 1,1-dimethylpropyl, t-butyl, methoxy, or phenoxy: or of Formula VI wherein $R^{V}$ and X are as defined above; of Formula VII wherein $R^{VI}$ is t-butyl: or of Formula VIII wherein $R^{VII}$ is 1,1,3,3-tetramethylbutyl.

22. A process for increasing the lubricity of a lubricating fluid which comprises adding an aryl arenesulfonate to the lubricating fluid in an amount greater than or equal to about 0.5 percent and less than or equal to about 5 percent based on the weight of the lubricating fluid, wherein the aryl arenesulfonate is of the formula $ASO_3A$, $ASO_3BSO_3A$, or $(ASO_3)_3B$ wherein A is independently in each occurrence phenyl or substituted phenyl, wherein when A is substituted phenyl the phenyl can be substituted by halo, keto, alkyl of up to 10 carbons, polyhaloalkyl, alkoxy, polyhaloalkoxy, aryl, polyhaloaryl, aryloxy, polyhaloaryloxy, polyhaloalkylaryl, or polyhaloaryloxy, and wherein B is benzene or two benzene rings connected by a divalent bridging group selected from the group consisting of $C(CH_3)_2$, O, $OCH_2$, $OCH_2CH_2$, $OCH_2CH_2O$, $C(CF_3)_2$, S, $SO_2$, CO, and 9,9'-fluorene.

23. The process of claim 22 wherein the amount is greater than or equal to about 1 percent.

24. The process of claim 22 wherein the lubricating fluid is a polyphenyl ether.

25. The aryl arenesulfonate of claim 22 wherein A is substituted phenyl and the halo substituent is fluoro or chloro.

26. The aryl arenesulfonate of claim 22 wherein the keto substituent is methyl keto or phenyl keto.

27. The aryl arenesulfonate of claim 22 wherein A is substituted phenyl and the alkyl substituent is an alkyl group containing up to eight carbons.

28. The aryl arenesulfonate of claim 27 wherein the alkyl substituent is methyl, t-butyl, or 1,1,3,3-tetramethylbutyl.

29. The aryl arenesulfonate of claim 22 wherein the polyhaloalkyl substituent is polyfluoroalkyl wherein the alkyl contains up to eight carbon atoms.

30. The aryl arenesulfonate of claim 22 wherein A is substituted phenyl and the alkoxy substituent is an alkoxy group containing up to seven carbon atoms.

31. The aryl arenesulfonate of claim 30 wherein the alkoxy substituent is methoxy, n-butoxy, n-hexoxy or n-heptoxy.

32. The aryl arenesulfonate of claim 22 wherein A is substituted phenyl and the aryl substituent is alkylphenyl, tri-t-butylphenyl, or halophenyl.

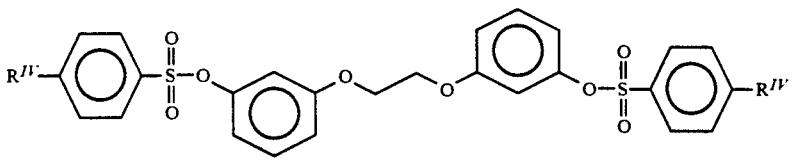

33. The aryl arenesulfonate of claim 32 wherein the halophenyl is fluorophenyl.

34. The aryl arenesulfonate of claim 22 wherein the polyhaloalkoxyaryl substituent is 1,1,3,3,3-pentafluoro-n-propoxy, 1,1,2,3,3,3-pentafluoro-n-propoxy, or trifluoromethoxy.

35. The aryl arenesulfonate of claim 22 wherein the polyhaloalkylaryl substituent is trifluoromethylphenyl.

36. The aryl arenesulfonate of claim 22 wherein the aryloxy group is phenoxy.

37. The aryl arenesulfonate of claim 22 wherein the polyhaloalkoxy group is polyfluoroalkoxy.

38. The aryl arenesulfonate of claim 22 wherein the divalent bridging group is $C(CH_3)_2$, O, $C(CF_3)_2$, S, $SO_2$, CO, or 9,9'-fluorene.

39. The process of claim 22 wherein the aryl arenesulfonate is of Formula I:

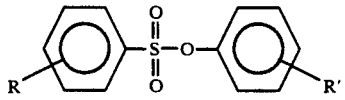

wherein R is hydrogen, 4-methyl, 4-t-butyl, 4-methoxy, 4-n-butoxy, 4-phenoxy, 4-trifluoromethoxy, or 4-(1,1,3,3,3-hexafluoro)-n-propoxy: R' is hydrogen, 4-t-butyl, 3-methoxy, 4-methoxy, 3-n-butoxy, 3-phenoxy, 4-(1,1,3,3-tetra methyl)butyl, 2-t-butyl, 4-n-heptoxy, 4-methyl, 2-t-butyl, 4-n-butoxy, 4-n-hexoxy, 3-methyl, 3-fluoro, 3-trifluoromethyl, 4-methyl keto, or 4-phenyl keto; of Formula II:

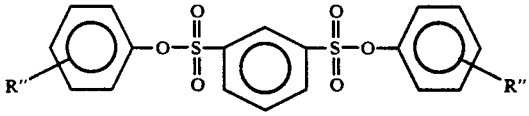

wherein R'' is 3-methoxy, 3-trifluoromethyl, 3-phenoxy, 4-phenoxy, 4-(4-chloro)phenoxy, or (1,1,3,3-tetramethyl)butyl; of Formula III:

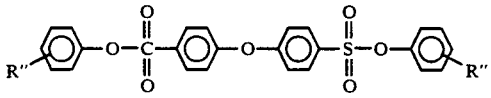

wherein R'' is as defined above; of Formula IV:

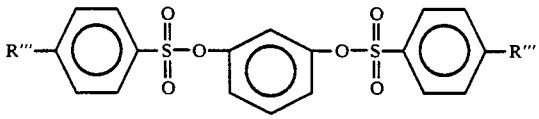

wherein R'''is (1,1-dimethyl) propyl, t-butyl, methoxy, n-butoxy, or phenoxy; of Formula V:

wherein $R^{IV}$ is n-butoxy; of Formula VI:

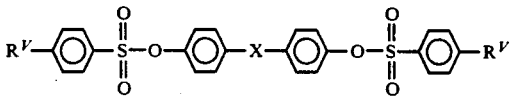

wherein $R^V$ is hydrogen, t-butyl, n-butoxy; X is dimethylmethylene, ditrifluoromethylmethylene, oxygen, sulfur, $SO_2$, CO, or 9,9-fluorene; of Formula VII:

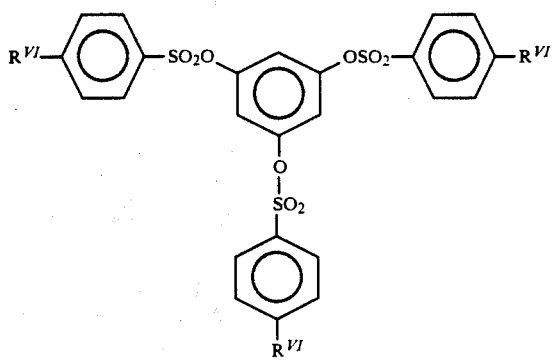

wherein $R^{VI}$ is t-butyl or n-butoxy; or of Formula VIII:

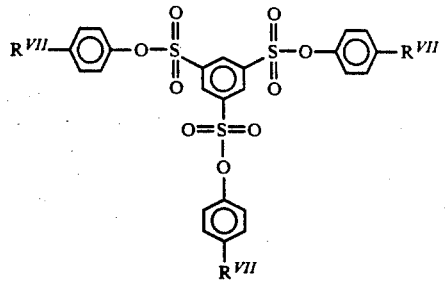

wherein $R^{VII}$ is 1,1,3,3-tetramethylbutyl.

40. The lubricating composition of claim 39 wherein the aryl arenesulfonate is of Formula I wherein R is hydrogen and R′ is hydrogen, 4-t-butyl, 3-methoxy, or 3-phenoxy, or wherein R is 4-methyl and R′ is hydrogen, 4-(1,1,3,3-tetramethylbutyl), or wherein R is 4-t-butyl and R′ is hydrogen, 2-t-butyl, 4-t-butyl, 4-(1,1,3,3-tetramethylbutyl), 3-methoxy, 3-n-butoxy, or wherein R is 4-methoxy and R′ is hydrogen, 4-t-butyl, or 3-methoxy, or wherein R is 4-n-butoxy and R′ is hydrogen or 3-phenoxy, or wherein R is 4-phenoxy and R′ is hydrogen, 3-methyl, 4-t-butyl, 4-(1,1,3,3-tetramethylbutyl), 3-fluoro, 3-trifluormethyl, 3-methoxy, 3-phenoxy, 4-phenyl keto, or wherein R is 1,1,2,3,3,3-hexafluoro-n-propoxy and R′ is 4-(1,1,3,3-tetramethylbutyl); of Formula II wherein R″ is 3-methoxy, 3-trifluoromethoxy, 3-phenoxy, 4-phenoxy, 4-(4-chlorophenoxy), or 4-(1,1,3,3-tetra-methylbutyl); of Formula III wherein R″ is 4-(1,1,3,3-tetramethylbutyl) or 3-trifluoromethyl and X is 0; of the Formula IV wherein R‴ is 1,1-dimethylpropyl, t-butyl, methoxy, or phenoxy; or of Formula VI wherein $R^{V}$ and X are as defined above; or of Formula VII wherein $R^{VI}$ is t-butyl; or of Formula VIII wherein $R^{VII}$ is 1,1,3,3-tetramethylbutyl.

* * * * *